US009909727B2

(12) United States Patent
Martin

(10) Patent No.: US 9,909,727 B2
(45) Date of Patent: Mar. 6, 2018

(54) LUMINAIRE WITH SELECTABLE EMISSION PATTERN

(71) Applicant: KONINKLIJKE PHILIPS N.V., Eindhoven (NL)

(72) Inventor: Paul Scott Martin, Eindhoven (NL)

(73) Assignee: Koninklijke Philips N.V., Eindhoven (NL)

( * ) Notice: Subject to any disclaimer, the term of this patent is extended or adjusted under 35 U.S.C. 154(b) by 141 days.

(21) Appl. No.: 14/916,809

(22) PCT Filed: Sep. 5, 2014

(86) PCT No.: PCT/IB2014/064271
§ 371 (c)(1),
(2) Date: Mar. 4, 2016

(87) PCT Pub. No.: WO2015/033296
PCT Pub. Date: Mar. 12, 2015

(65) Prior Publication Data

US 2016/0215943 A1 Jul. 28, 2016

(30) Foreign Application Priority Data

Oct. 1, 2013 (EP) ..... 13186888

(51) Int. Cl.
*F21V 3/00* (2015.01)
*F21V 5/00* (2015.01)
(Continued)

(52) U.S. Cl.
CPC ..... *F21S 10/00* (2013.01); *F21S 48/212* (2013.01); *F21S 48/215* (2013.01);
(Continued)

(58) Field of Classification Search
CPC ..... F21K 9/00; F21K 9/23; F21K 9/60; F21K 9/64; F21K 9/65; F21K 9/66; F21K 9/69;
(Continued)

(56) References Cited

U.S. PATENT DOCUMENTS 3,393,310 A 7/1968 Ream
4,009,309 A 2/1977 Holt
(Continued)

FOREIGN PATENT DOCUMENTS

DE 1157567 B 11/1963
DE 202008015080 U1 1/2009
(Continued)

OTHER PUBLICATIONS

EPO as ISA, PCT/IB2014064271, filed Sep. 5, 2014, "International Search Report and Written Opinion" dated Nov. 20, 2014, 13 pages.
(Continued)

*Primary Examiner* — Jason Moon Han
(74) *Attorney, Agent, or Firm* — Brian D. Ogonowsky; Patent Law Group LLP

(57) ABSTRACT

A luminaire (12), such as an external light for an automobile or a wall sconce, includes at least first set of optical features (16B, 16F) and a second set of optical features (16A, 16C, 16E, 16G). The first set of optical features (16B, 16F) is configured for use with an LED bulb (10) emitting a first type of light emission pattern (20), such that the luminaire outputs a particular light emission pattern. The second set of optical features (16A, 16C, 16E, 16G) is configured for use with a bulb (10) emitting a second type of light emission pattern (24), such that the luminaire outputs a different type of light emission pattern. In this way, the same luminaire may output different light emission patterns depending on the emission pattern of the bulb. The luminaire's emission pattern may also be dependent on the color emitted by the
(Continued)

bulb. Different bulbs may be used or different LEDs may be energized in a single bulb to generate the emission patterns.

15 Claims, 5 Drawing Sheets

(51) Int. Cl.

| | |
|---|---|
| ***F21S 10/00*** | (2006.01) |
| ***F21V 3/02*** | (2006.01) |
| ***F21V 9/08*** | (2018.01) |
| ***F21S 8/10*** | (2006.01) |
| *F21S 8/00* | (2006.01) |
| *F21W 121/00* | (2006.01) |
| *F21K 9/23* | (2016.01) |
| *F21Y 115/10* | (2016.01) |

(52) U.S. Cl.
CPC ..... *F21S 48/2212* (2013.01); *F21S 48/2218* (2013.01); *F21V 3/02* (2013.01); *F21V 9/08* (2013.01); *F21K 9/23* (2016.08); *F21S 8/033* (2013.01); *F21W 2121/00* (2013.01); *F21Y 2115/10* (2016.08)

(58) Field of Classification Search
CPC ..... F21S 10/00; F21S 48/212; F21S 48/215; F21S 48/22; F21S 48/2212; F21S 48/2218; F21V 3/02; F21V 5/00; F21V 5/008; F21V 9/08; F21V 13/00; F21V 13/02; F21V 13/04; F21V 13/12; F21V 13/14; F21V 19/006; F21V 19/01
USPC ..... 362/249.02, 311.02, 800
See application file for complete search history.

(56) References Cited

U.S. PATENT DOCUMENTS

| | | | |
|---|---|---|---|
| 5,749,646 | A | 5/1998 | Brittell |
| 6,336,734 | B1 | 1/2002 | Arumugasaamy |
| 7,352,011 | B2 | 4/2008 | Smits et al. |
| 8,172,434 | B1 | 5/2012 | Olsson |
| 2003/0206418 | A1 | 11/2003 | Strazzanti |
| 2013/0114242 | A1 | 5/2013 | Pickard et al. |

FOREIGN PATENT DOCUMENTS

| | | | |
|---|---|---|---|
| EP | 2589861 | A2 | 2/2013 |
| GB | 1138096 | A | 12/1968 |
| WO | 2005085704 | A1 | 9/2005 |
| WO | 2009150574 | A1 | 12/2009 |
| WO | 2011131197 | A1 | 10/2011 |

OTHER PUBLICATIONS

European Search Report dated Feb. 18, 2014 from European Patent Application No. 13186888.7, 4 pages.
Article 94(3) EPC dated Jan. 10, 2017, European Patent Application No. 14771401.8, 6 pages.

LUMINAIRE WITH SELECTABLE EMISSION PATTERN

CROSS-REFERENCE TO RELATED APPLICATIONS

The present application is a § 371 application of International Application No. PCT/IB2014/064271, filed on Sep. 5, 2014 and entitled "LUMINAIRE WITH SELECTABLE EMISSION PATTERN," which claims priority to International Application No. PCT/CN2013/001053, filed on Sep. 9, 2013 and European Application No. 13186888.7, filed on Oct. 1, 2013. PCT/IB2014/064271, PCT/CN2013/001053, and 13186888.7 are incorporated herein.

FIELD OF THE INVENTION

This invention relates to luminaires containing light emitting diodes (LEDs) and, in particular, to a technique for varying an emission pattern of such a luminaire.

BACKGROUND

An example of a luminaire in an automobile is the tail light assembly, comprising an outer plastic cover, redirection prisms, a reflector, a socket, and a bulb located at approximately the focal point of the reflector. The bulb may include two filaments, where one filament is energized for a constant tail light, and both filaments are energized for a brighter stop indication. In both cases, the emission pattern of the bulb is lambertian. There may be multiple compartments in the luminaire for side lights and turn signals, and each compartment houses an associated bulb. Since filament bulbs have a lambertian emission, only by changing the optical features of the luminaire can the emission pattern of the luminaire be changed.

Government regulations dictate the emission patterns for all exterior vehicle lighting including, for example, tail lights and head lights. Exterior lighting for vehicles is dominated by standardized filament lamps, which are largely lambertian sources, so the differences in radiation patterns of the luminaires are primarily due to differences in the luminaire design. For different jurisdictions, therefore, a different luminaire must be designed to create the required emission patterns. The result is that the optical features, including color filters, of the luminaire must be different depending on where the vehicle is sold.

Recently, incandescent light bulbs have been substituted with LED bulbs. These solid state bulbs have the same or similar socket connecting features as traditional bulbs, allowing them to be retrofit into existing luminaires. However, the LED bulbs emulate the incandescent bulbs and output a lambertian pattern, where the reflector and other optics in the luminaire are used to shape the beam.

Luminaires, particularly those in cars, often serve more than one purpose. For example, the luminaire needs to provide a color and light pattern to meet regulatory requirements but it is also an important styling element. Recent higher end vehicles have taken much advantage of LEDs and novel optics to create brand-linked styling elements, such as BMW's light rings for a front position lamp, or Audi's "eyebrow light" for a daytime running lamp. Also, in the rear of the car, the tail lamp has become an important styling element, with each car model show-casing a new look but maintaining features that link to the car brand.

As with all fashion elements, the "refresh time" is important to keeping the luminaire, and therefore the vehicle, looking fresh and modern. Refresh times for vehicles have reduced over many decades of car production and, as of this writing, are typically 2-3 years for a car model refresh and 4-5 years for completely new car models. New vehicle luminaires have similar 2-3 year design and manufacturing cycles and are often some of the most visible styling features of a car. Luminaires like the stop/tail rear lamp are designed to fit a single bulb type, and different luminaires are designed to meet the regulated radiation pattern and styling needs of different countries and/or regulated regions. One result is that a single car model can therefore require several different luminaires to be designed and manufactured to meet different regulations and, when styling refresh is desired, the luminaire must again be redesigned and separately manufactured.

WO2011/131197A1 discloses an illumination device with an assembly of at least two groups of light sources, which light sources are individually controllable. Each group of light sources is assembled with different lenses, mixers or reflectors. The first group of light sources is configured to pass through non-diffusing regions of a diffuser cover, and the second group of light sources is configured to pass through diffusing regions of the diffuser cover.

What is needed is a luminaire whose light emission can be rapidly and inexpensively changed to meet different regulated requirements and to have different styling features.

SUMMARY

A luminaire is designed to output different light emission patterns when using different LED bulbs installed in the luminaire, where each bulb outputs a different light emission pattern or color spectra. The luminaire contains different sets of optical features associated with the different emission patterns or colors that can be output by the different bulbs and reflect, refract, and/or filter the bulb's emission to achieve the desired luminaire output. With such a luminaire, the same luminaire can be installed in automobiles that will be used in different jurisdictions having different light emission/color regulations, and only the bulb needs to be changed for the particular jurisdiction. Additionally, the styling of the light emission of the luminaire may be changed simply by changing the bulb.

In another embodiment, the bulb itself is controllable to output two or more light emission patterns or colors, such as by energizing different leads of the bulb or by digitally controlling a switch inside the bulb.

In one example, the luminaire has a first set reflectors and windows that are located in the luminaire to reflect and output a light emission from a first bulb type installed in a socket so that the luminaire's light emission has a particular first pattern. The luminaire also has a second set of reflectors and windows that reflect and output a light emission from a second bulb type installed in the socket so that the luminaire's light emission has a particular second pattern.

In another example, the luminaire has different color filters forming different output windows, and different bulbs having different color spectra emissions cause the luminaire to output different emission patterns and colors.

The various light emission patterns/colors output by the luminaire as a result of the different bulb emission patterns/colors may be for meeting different regulations or for changing aesthetic styling. Therefore, a single type of luminaire may be installed in an automobile, and its light emission may be changed to meet regulations simply by the proper selection of a bulb. New bulb designs may be developed after the luminaire is installed to meet new regulations or create new stylings.

The luminaire may also be for decorative home or office lighting, such as a wall sconce.

BRIEF DESCRIPTION OF THE DRAWINGS

Elements that are the same or similar are labeled with the same numeral.

DETAILED DESCRIPTION

Figure 1:
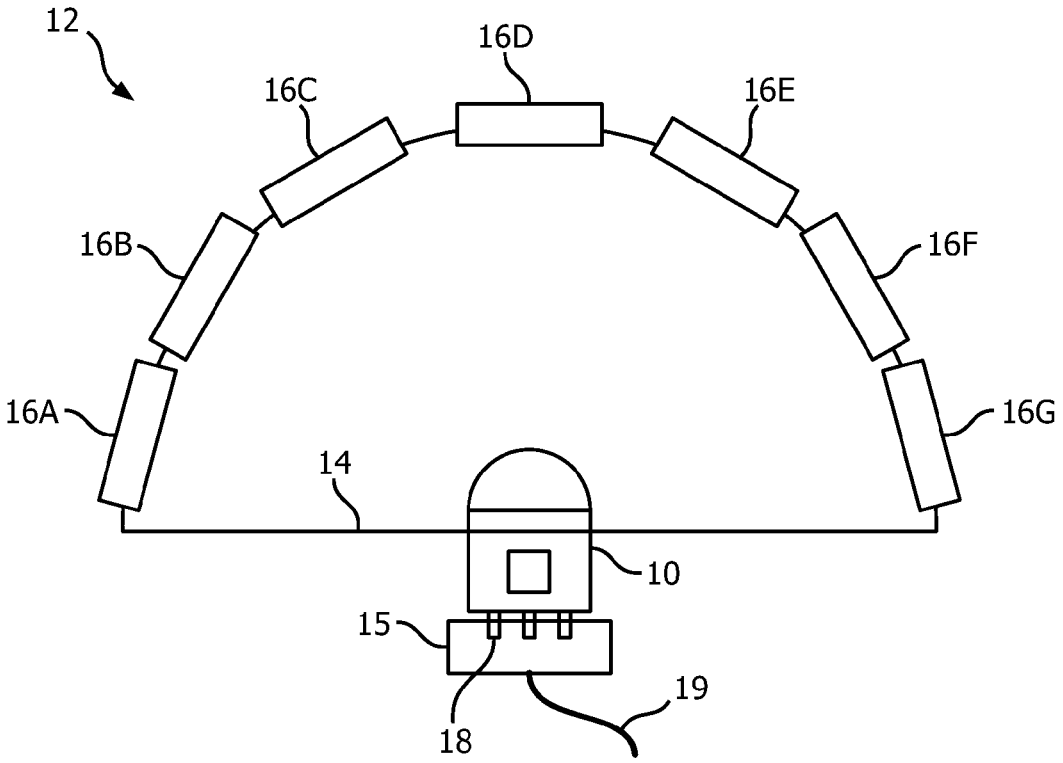
FIG. 1 is a cross-sectional, bisected, view of a luminaire having different optical sections, a reflector, a socket, and an LED bulb that provides selectable emission patterns.

By designing solid state LED bulbs with different radiation patterns and appropriately designing the luminaire, it is possible to provide a single luminaire which will meet multiple radiation pattern requirements (styling, regulatory, or other) simply by changing the bulb. In this manner, for instance, a stop/tail luminaire may be designed to show horizontal lines when illuminated by a particularly designed and inserted bulb, and the same luminaire might show vertical lines when illuminated by a different bulb radiation pattern. Such a luminaire could therefore allow a manufacturer, or even end car users, to change the optical styling of the tail lamp simply by changing the bulb, therefore dramatically shortening the time and cost for styling refresh and allowing car customers to choose their own tail light styling by purchasing different after-market bulbs.

Governmental regulations dictate specific emission patterns for automobile lights, such as tail lights. The regulations may be different for different jurisdictions. A single luminaire, in accordance with one example of the invention, may include various regions that are illuminated by different light emission patterns output by different bulb to create different emission patterns to comply with different regulations for light emission. The excitation of the different regions can be but does not have to be optically exclusive. It can be equally effective to have some light spill into non-primary regions to enhance style, but the styles should be visibly different when different bulb radiation patterns are inserted into the luminaire. It may in fact be sufficient just to vary the intensity of light excitation for creating different light emission patterns of the luminaire, such as if phosphors were employed in the luminaire that convert blue or UV LED light into other colors.

To ensure that bulbs meet governmental regulatory requirements in the region of use, the socket in the luminaire can be keyed in various ways to ensure that all bulbs that are properly approved and fit the keying will meet regulation, even though their styling appearance is different. Luminaire and bulb combinations can be designed and manufactured one time to optimally meet automobile requirements in US (SAE) and Europe (ECE), which have different radiation pattern requirements. Thus, the viewed radiation pattern is selected by which bulb is put into the luminaire and not by designing two luminaires, one for US and one for Europe.

The luminaire may include different sets of reflectors, refractors (e.g., prisms), filters, window placements, or other optical features designed for the different bulb emission patterns.

The different radiation patterns from the luminaire can be either the result of different single-radiation pattern bulbs being inserted into the luminaire and exciting different optical elements in the luminaire, or can be the result of different bulb radiation patterns being generated by from the same bulb by selectively energizing different LEDs within the bulb.

Additionally, the emission from the luminaire may be selected by selecting the color spectrum (the photometric spectrum) of the bulb's emissions, where optical features of the luminaire, such as color filters, affects the luminaire's emission based on the bulb's color spectra.

For example, one set of reflectors in the luminaire mated with a specific LED bulb may cause the luminaire to produce a donut shape (toroid) emission pattern as seen from outside the luminaire, with an angle of maximum brightness about 45 degrees from normal. Another separate set of reflectors or other optical elements within the same luminaire may generate an emission pattern having a combination of a low, thin pattern with an angle of maximum brightness about 75 degrees from normal, and a more vertical emission pattern. In one embodiment, the two emission patterns from the two sets of reflectors or other optical elements within the luminaire do not substantially overlap. The emission patterns need not be circular. Other emission patterns may be distinguished from each other by color.

In one embodiment, a single LED bulb is capable of generating a multiplicity of radiation patterns. By selecting the radiation pattern output by bulb, the user can, for instance, electronically or wirelessly select the desired radiation pattern of the luminaire. For example, the user may select a horizontal emission pattern or a vertical emission pattern, or change the color of the bulb's emission to change the emission pattern. This is all possible without changing the bulb or the hardware of the luminaire. In another embodiment, the socket itself, by energizing a certain subset of the leads of the bulb, selects which radiation pattern the bulb will generate. Accordingly, the manufacturer only needs to install different sockets for the different jurisdictions rather than providing different luminaires.

A luminaire, containing various sets of optical features, may be designed to handle the two different bulb emission patterns differently to accomplish different functions. For example, for a luminaire in an automobile, one emission pattern may be more directed to the rear of the automobile, and the other emission pattern may be more lambertian or direct the light sideways to achieve different safety functions. In another example, different LED colors are associated with the two or more bulb emission patterns, such as red, amber and white, used for a stop indication, a turn indication, a tail light, and a reverse light. Each color may have a peak emission in a different direction. The selected bulb emission pattern/color, in combination with the luminaire optical features, may direct light to a first color filter in the plastic luminaire or direct light to a clear portion or other color filter.

Other combinations and applications are envisioned. For example, the same flexibility is often desired in lighting luminaires used in homes and offices, such as wall sconces where the radiation pattern projected onto the wall is a key styling feature. By using luminaires designed with different reflector/prism/refractive features or other optical features that are excited by different bulb radiation patterns, the home owner can change the styling of the wall lighting simply by changing the bulb without the added time and expense required to change the wall sconce fixture.

FIG. 1 illustrates an LED bulb 10 mounted in a light-transmitting, domed luminaire 12. The luminaire 12 may be any shape, and a dome was selected for simplicity. A bottom reflector 14 may be shaped to direct light upward. The luminaire 12, reflector 14, and bulb 10 may be part of a tail light assembly in an automobile, or may be a wall sconce or other lighting unit. The LED bulb 10 is mounted into the luminaire 12 via a socket 15 which may have a keying mechanism, such as tabs, that properly aligns the bulb 10 in the socket 15 and restricts the use of the bulb 10 to that particular socket type. The socket 15 may have another keying mechanism to align the socket 15 when installing the socket 15 into the luminaire 12. The bulb 10 may twist into the socket 15 or have leads that are inserted into the socket 15. The socket 15 will typically have a wire connector 19 that connects to wires leading to the luminaire 12, and the socket 15 may screw into an opening in the back of the luminaire 12.

In one embodiment, the bulb comprises a molded plastic cover over a thermally conductive substrate that contains LED dies and optical lenses.

Different optical sections 16A-16G of the luminaire 12 are identified. These sections may be various shapes or colors, may be the same shape or color, may have different prism patterns for redirecting light reflection or refraction, or diffusion, or may have any other optical features. In one embodiment, the optical features of the sections 16A-16G are the same and, in another embodiment, the sections 16A-16G have optical features and are not identical. In another embodiment, the sections 16A-16G comprise different color filters. Using the optical features of sections 16A-16G, the radiation patterns visible when looking at the luminaire 12 may form rings, blocks, lines, different colors, or other optical appearances depending on the application.

The bulb 10 comprises electrical leads 18 that are connected to a power source, such as an automobile battery or the mains, via the socket 15. Different combinations of the leads 18 may be connected to the power source to energize different sets of LED dies in the bulb 10. Alternatively, the leads 18 may be connected to the power source to energize the same LEDs at different power levels, such as may be done with a tail light mode (dim) and stop light mode (bright) in an automotive tail lamp or may be done in a wall sconce in a bright mode or a dim mode.

The different sections 16A-16G of the luminaire 12 optically transform the light from the LED bulb 10 into different luminaire emission patterns. There may be different numbers of sections within the luminaire or different optical elements used to perform the radiation transformation function from bulb to luminaire.

If a single bulb 10 has selectable emission patterns, different selectable sets of LED dies in the LED bulb 10 emit light having different emission patterns. The different sets of LED dies may be different colors, the same color, different brightness levels, etc. There may be different numbers of LED dies in each set.

Figure 2:
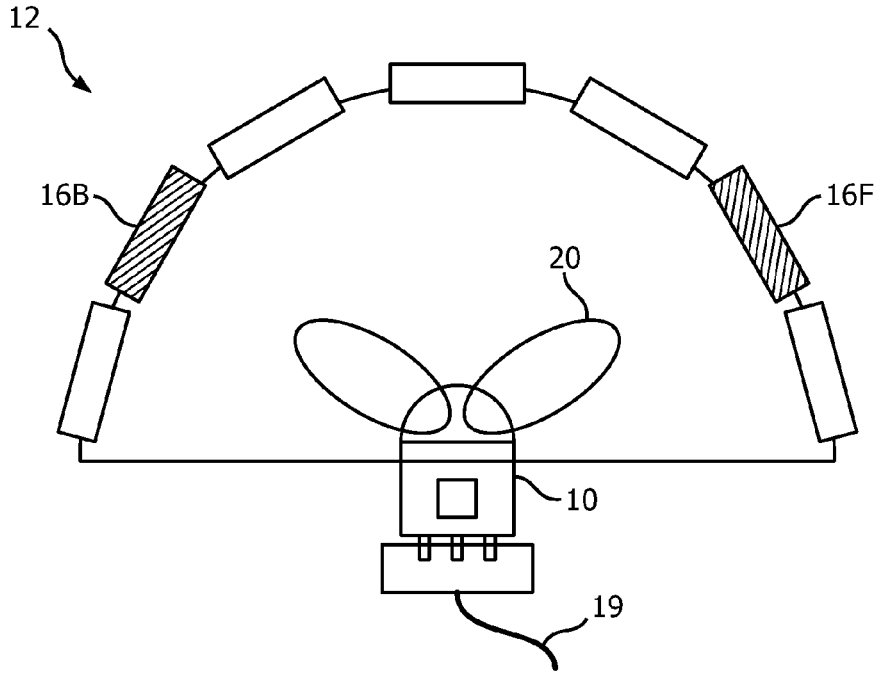
FIG. 2 illustrates the luminaire of FIG. 1 showing how a first emission pattern of the bulb directs light to certain optical sections of the luminaire to create a second emission pattern output from the luminaire.

FIG. 2 illustrates an example of a first emission pattern 20 from the bulb 10 when a first set of LED dies is energized, or when a first type of bulb 10 is used. The angle of maximum brightness may be about 30-45 degrees in the example. The emission pattern 20 may be symmetrical or asymmetrical, and may be a toroid, two separated half-toroids, or other shape.

FIG. 2 also illustrates how the first emission pattern primarily illuminates the sections 16B and 16F of the luminaire 12. The sections 16B and 16F may have optical characteristics that are different from those of the other sections, such as providing red filtering for a stop light indication or amber filtering for a turn signal indication. The sections 16B and 16F may for part of the same ring. The optical features may include refractive or reflective elements for directing the light such that light from the illuminated sections creates the desired radiation pattern from the luminaire. Other optical features are envisioned depending on the application.

Figure 3:
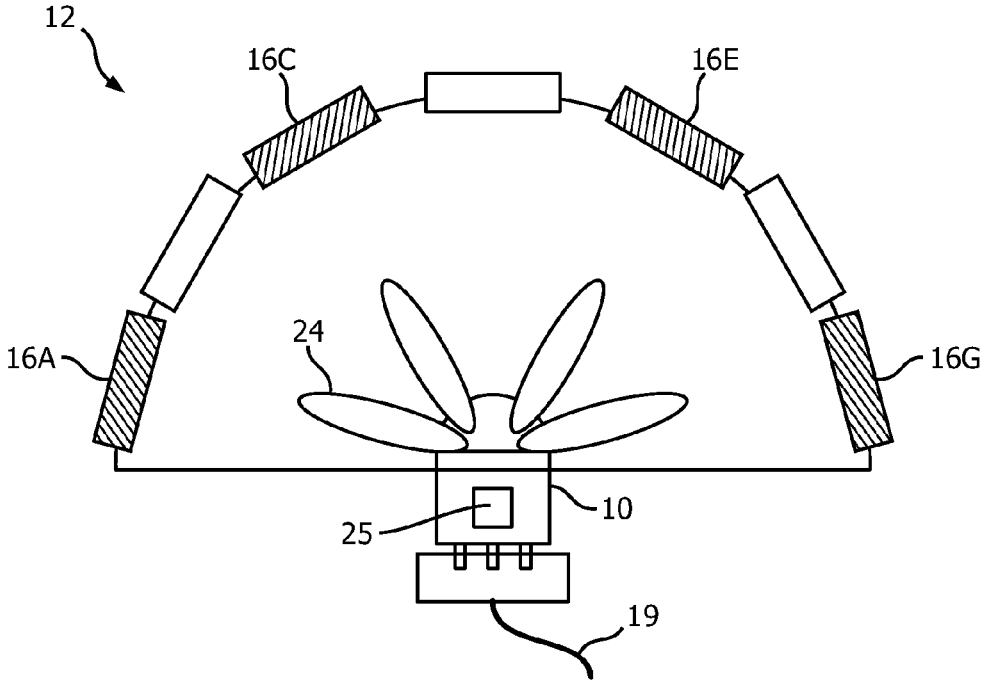
FIG. 3 illustrates the luminaire of FIG. 1 where a different bulb, outputting a different emission pattern, directs light to other optical sections of the luminaire to create another emission pattern output from the luminaire.

FIG. 3 illustrates an example of a second emission pattern 24 from the bulb 10 when a second set of LED dies is energized. The second emission pattern 24 may have two maximum brightness peaks at, for example, between 10-30 degrees and between 45-75 degrees. The emission may be symmetrical or asymmetrical, and may be a toroid, two separated half-toroids, or other shape.

FIG. 3 also illustrates how the second emission pattern 24 primarily illuminates the sections 16A, 16C, 16E, and 16G of the luminaire 12. The sections 16A, 16C, 16E, and 16G may have optical characteristics that are different from those of the other sections, such as providing red filtering for a stop light indication, or amber filtering for a turn signal indication, or no filtering for a brighter white light reverse light. The sections 16A and 16G may form part of an outer ring, and the sections 16C and 16E may form part of an inner ring. The optical features may include prism or reflector patterns for directing the light. Other optical features, or no optical features (clear areas), are envisioned depending on the application.

In another embodiment, the sections 16A-16G for rings of various color filters, and the particular color emission from the bulb 10 determines the perceived brightness of light emitted from each of the color filters to create different patterns of light.

The luminaire 12 may be any shape suitable for its application, such as a quarter dome shape for a tail light assembly. Similarly, the reflector 14 may be any shape suitable for its application, such as a parabolic reflector for directing light emitted by the bulb 10 in a certain direction. The reflector 14 may comprise multiple parabolic reflectors for reflecting the different emission patterns of light emitted by the bulb 10 in different directions.

It is also envisioned that specific sections of the luminaire may have optical coatings such as color absorbers or gratings that selectively parse the spectrum of radiation incident on said luminaire section such that the apparent color of the luminaire, as viewed from a specific angular direction, is a subset of the colors incident on the section of the luminaire.

It is further envisioned that specific sections of the luminaire may have phosphorescent materials which convert some or all of the electro-magnetic radiation incident on the section into a different spectral color. A near-UV LED emission, poorly visible by the human eye, can be turned into bright white or color with use of phosphors. Accordingly, energizing the UV or blue LEDs in the bulb creates a pattern dictated by the phosphor design.

The set of LED dies for producing the desired emission pattern may be selected by supplying power to different combinations of the three electrical leads 18 extending from the bulb 10. The bulb 10 leads 18 may comply with any suitable standard, such as standards for automobile lights. In one embodiment, the selection of which LED radiation pattern to create is done by selectively energizing different LED elements with different powers. The selection can be done wirelessly, such as via a mobile phone application, or done using electronic and/or mechanical keying of the bulb into the bulb socket. A controller 25 in the bulb 10 may receive digital signals via the leads 18 or wireless signals and apply power to the selected set of LED dies. RFID, blue tooth, WiFi, or other wireless techniques can be used.

In another embodiment, there is a multiplicity of bulbs that may be used in the luminaire, each of which creates only a single radiation pattern.

Figure 4:
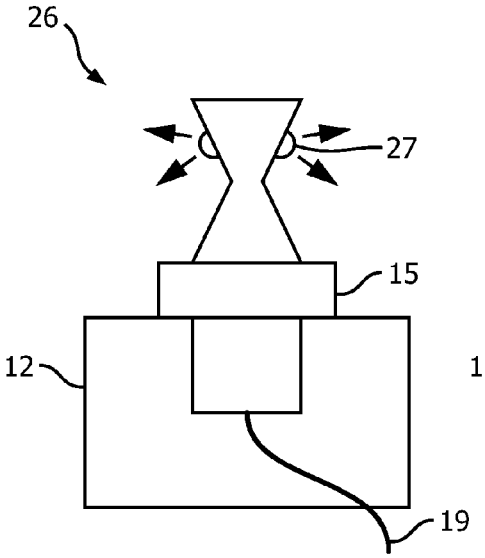
FIG. 4 is an example of a first type of LED bulb that outputs a first emission pattern that may be used in a first luminaire to cause the luminaire to output a second emission pattern.

FIG. 4 is a cross-sectional view of a portion of a luminaire 12, where the socket 15 is screwed into the luminaire body. An LED bulb 26 has encapsulated LEDs 27 that are directed generally at a downward angle to produce a light emission pattern which is generally a mirror image of the emission pattern of FIG. 9.

Figure 5:
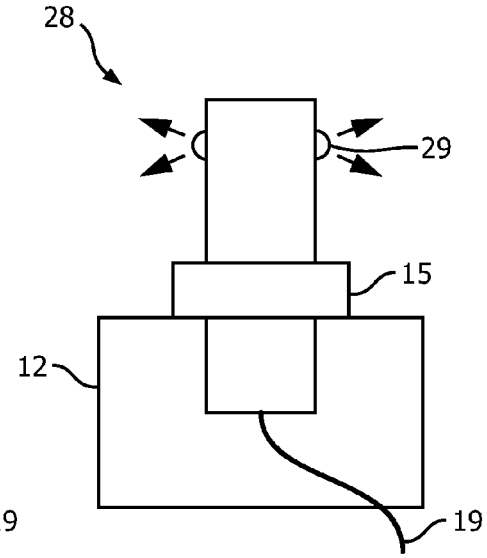
FIG. 5 is an example of a second type of LED bulb that outputs a third emission pattern that may be used in the first luminaire to output a fourth emission pattern.

FIG. 5 is a cross-sectional view of a portion of a luminaire 12, where the socket 15 is screwed into the luminaire body. An LED bulb 28 has encapsulated LEDs 29 that are directed generally in a horizontal direction to produce a light emission pattern which is generally that of FIG. 10.

The different bulbs of FIGS. 4 and 5 can be installed in the same luminaire 12 to cause the luminaire 12 output different emission patterns. The luminaire 12 will generally be specifically designed to accommodate the two bulb's emission patterns to produce the desired output emission pattern, such as a pattern required by a jurisdictional regulation. For example, the bulb of FIG. 4 may primarily illuminate the lower sections of the luminaire 12 of FIG. 1, and the bulb of FIG. 5 may primarily illuminate the middle sections of the luminaire 12 of FIG. 1. Other LEDs may be mounted on the top of the bulbs to illuminate the top sections of the luminaire 12 of FIG. 1.

Figure 6:
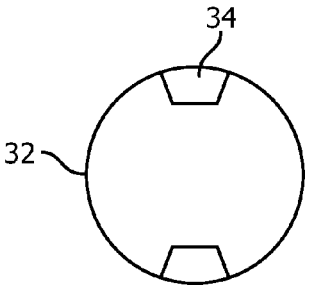
FIG. 6 is a top down view of a mechanical key (tabs) in a socket assembly opening in a luminaire which corresponds to a key on a bulb for restricting the use of a particular type bulb in the socket.

FIG. 6 is a top down view of an opening 32 in a socket assembly for receiving the LED bulb. FIG. 6 shows tabs 34 that align with indentations in the bulb housing to restrict the use of only that type of bulb in the luminaire. A particular socket assembly is installed in the luminaires that are sold in a jurisdiction that requires a certain luminaire emission pattern achievable with a certain type of bulb. For other jurisdictions, the same luminaire is used but having a different socket. The sockets are generally screwed into the luminaire.

Figure 7:
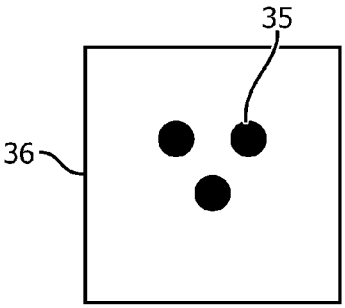
FIG. 7 is a top down view of a connector pattern in a socket assembly in a luminaire which corresponds to a connector pattern of a bulb for restricting the use of a particular type bulb in the socket.

FIG. 7 is a top down view of a connector pattern 35 in a socket assembly 36 in a luminaire which corresponds to a connector pattern of a bulb for restricting the use of a particular type bulb in the socket. This is an alternate keying method to restrict the use of certain bulbs with certain sockets. Further, the connection of the power source to the bulb connectors may be different for the different socket assemblies so that only the proper bulb will operate with a particular socket.

Figure 8:
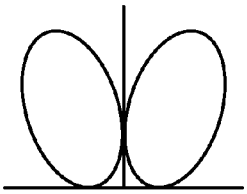
FIG. 8 illustrates a first emission pattern of an LED bulb.
Figure 9:
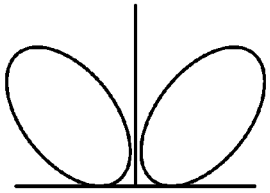
FIG. 9 illustrates a second emission pattern of an LED bulb.
Figure 10:
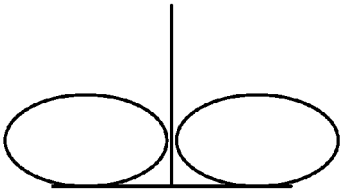
FIG. 10 illustrates a third emission pattern of an LED bulb.

FIGS. 8-10 are polar plots of some examples of emission patterns that may be output from an LED bulb, typically depending on the angle of the LED dies within the bulb and reflectors within the bulb.

Figure 11:
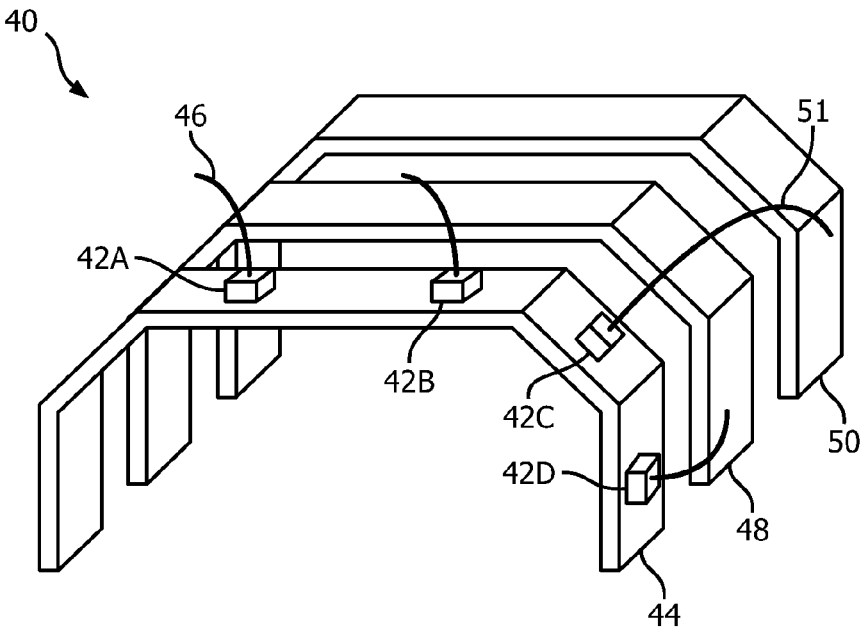
FIG. 11 illustrates LEDs mounted on bent leads of a lead frame in a bulb to create desired emission patterns.

FIG. 11 illustrates part of a bulb 40 in accordance with one embodiment of the invention. Only four LED dies 42A-42D (collectively LED dies 42) are shown but many more may be used depending on the brightness and emission patterns desired. Counterpart LED dies may be on the other side of the bulb 40 but obscured in FIG. 11 to create a more symmetrical emission pattern.

The LEDs dies 42 shown are vertical dies, but lateral and flip-chip dies may also be used. The bottom cathode metal electrodes of the LED dies 42 are bonded directly to the lead frame strip 44 for a good electrical and thermal coupling. The LED dies 42A, 42B, and 42D have their top anode electrodes connected via wires 46 to the lead frame strip 48. The lead frame strips 46, 48, and 50 may be copper and plated with a reflective silver layer. Therefore, connecting the power supply to the strips 44 and 48 (terminating in two of the leads 18 in FIG. 1) illuminates LED dies 42A, 42B, and 42D (and an LED die similar to LED die 42D obscured in FIG. 11) to create an emission pattern similar to that shown in FIG. 3.

The LED die 42C has its top anode electrode connected via a wire 51 to the lead frame strip 50. Therefore, connecting the power supply to the strips 44 and 50 illuminates LED die 42C (and an LED die similar to LED die 42C obscured in FIG. 11) to create an angled emission pattern, such as shown in FIG. 2

There may be more lead frame strips and more LED dies. Some LED dies connected to the same lead strips may be connected in parallel. LED dies may also be connected in series by the anode wires from first LED dies mounted to a first strip being connected to a second strip having mounted thereon second LED dies. The anodes of the second LED dies are connected to a third strip so that the first LED dies are connected to the second LED dies in series. Any number of LED dies may be connected in series and parallel in this manner to provide any voltage drop and any brightness.

The lead frame strips may be bent in other patterns, or curved (e.g., in a U-shape), to create other emission patterns. Any number of LED dies can be mounted at any angle on the bent lead frame.

The LED dies on the different sections of the lead frame strip 44 may be different colors so each emission pattern has a different color. The LED dies may be red, amber, and white LED dies or any other colors. The colors may be generated by a blue LED die with a suitable phosphor so all the LED dies have the same voltage drop.

A connector may connect the ends of the strips 44, 48, and 50 to the leads 18 of the bulb 10.

The LED dies and lead frame may be enclosed in the bulb 10 such as by molding a transparent material (e.g., a plastic) around the LED dies and lead frame. The outer surface of the bulb 10 may be any shape, including shapes that further shape the emissions. The LED dies may be separately encapsulated by a resilient material, such as silicone, to account for the different coefficients of thermal expansion of the materials.

The optical characteristics of the bulb's 10 surface may also affect the emission patterns for the illuminated LED dies. For example, the bulb 10 may have Fresnel lenses in its outer surface that redirect the LED light to create the desired emission patterns. Alternatively, the bulb 10 has a hemispherical smooth surface that does not significantly affect the emission pattern emitted by the LED dies. Alternately, the bulb 10 may have encapsulated LED dies forming part of its outer surface, as shown in FIGS. 4 and 5.

Figure 12:
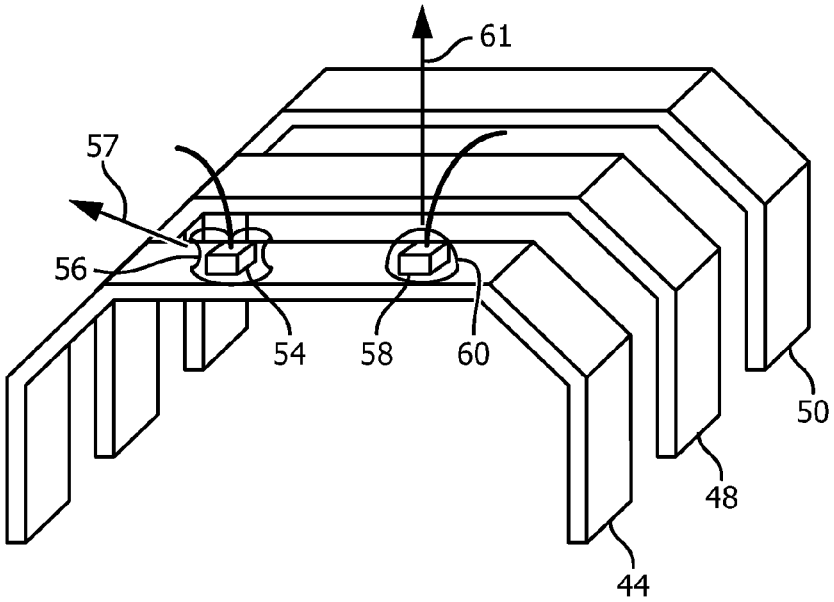
FIG. 12 illustrates the use of different lenses over the LED dies to create the different emission patterns.

Other techniques may be used to cause different sets of LED dies to generate different emission patterns. For example, each LED die in an array of LED dies may have primary optics (a lens) that directs light in the desired direction, as shown in FIG. 12. In FIG. 12, the LED die 54 has a lens 56 that causes the peak emission to be zero degrees (as shown by light ray 57), while the LED die 58 has a lens 60 that causes the peak emission to be at 30 degrees (as shown by light ray 61). The LED dies 54 and 58 may be energized separately by application of power to different combinations of the lead frame strips 44, 48, and 50. Various lenses for shaping the light from an LED die are well known and some examples are found in U.S. Pat. No. 7,352,011, assigned to the present assignee and incorporated herein by reference. In U.S. Pat. No. 7,352,011, a lens producing any emission characteristic is directly molded over an LED die. U.S. Pat. No. 7,352,011 describes lenses that are characterized as side-emitting lenses, hemispherical lenses, and other lenses that have a selectable peak emission within 50-80 degrees.

Figure 13A:
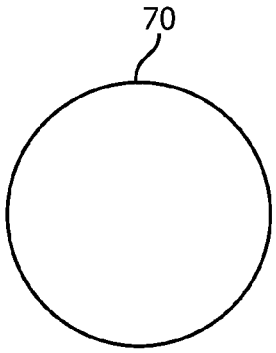
FIGS. 13A and 13B are top down views of two luminaires, such as wall sconces.
Figure 13B:
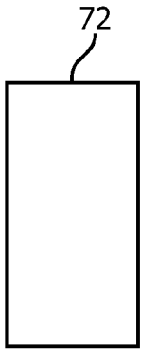

FIG. 13A is a simplified front view of a first type of luminaire 70, and FIG. 13B is a simplified front view of a second type of a luminaire 72. The luminaire 70 may be that of FIG. 1, where the various sections 16A-16G form concentric rings, which may be diffusers, color filters, refractors, windows, etc.

Figure 14A:
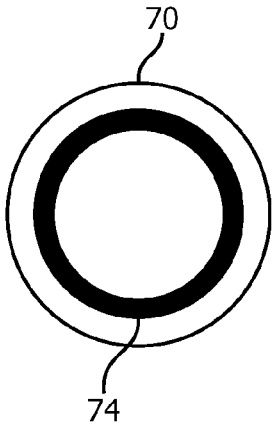
FIGS. 14A and 14B illustrate the light pattern from the luminaires of FIGS. 13A and 13B, due the luminaires' first set of optical features, when the bulb of FIG. 2 is installed in the luminaires.

FIG. 14A illustrates the luminaire 70 containing a bulb, such as the bulb of FIG. 2, where the bulb's emission pattern (similar to that shown in FIG. 2 or 9) causes a single ring 74 to be illuminated in the luminaire 70. This may correspond to the ring formed by sections 16B and 16F in FIG. 2.

Figure 14B:
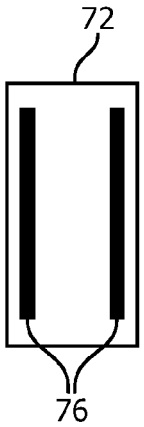

FIG. 14B illustrates the luminaire 72 containing a bulb, such as the bulb of FIG. 2, where the bulb's emission pattern (similar to that shown in FIG. 2 or 9) causes a vertical line pair 76 to be illuminated in the luminaire 72.

Figure 15A:
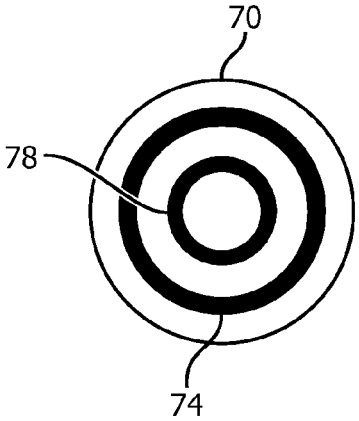
FIGS. 15A and 15B illustrate the light pattern from the luminaires of FIGS. 13A and 13B, due to the luminaires'second set of optical features, when the bulb of FIG. 3 is installed in the luminaires. The different bulb emission patterns may be generated by different bulbs or by the same bulb controlled to output a selectable light pattern.

FIG. 15A illustrates the luminaire 70 containing a bulb, such as the bulb of FIG. 3, where the bulb's emission pattern (similar to that shown in FIG. 3) causes concentric rings 74 and 78 to be illuminated in the luminaire 70. This may correspond to the rings formed by sections 16A, 16C, 16E, and 16G in FIG. 3.

Figure 15B:
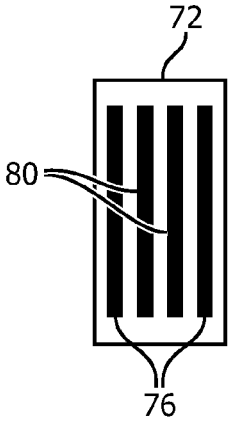

FIG. 15B illustrates the luminaire 72 containing a bulb, such as the bulb of FIG. 3, where the bulb's emission pattern (similar to that shown in FIG. 3) causes two vertical line pairs 76 and 80 to be illuminated in the luminaire 72.

Other designs are contemplated, and any number of emission patterns may be output by the bulb.

While particular embodiments of the present invention have been shown and described, it will be obvious to those skilled in the art that changes and modifications may be made without departing from this invention in its broader aspects and, therefore, the appended claims are to encompass within their scope all such changes and modifications as fall within the true spirit and scope of this invention.

The invention claimed is:

1. A light emitting device comprising:

at least one light emitting diode (LED) bulb containing at least one LED; and a luminaire having a socket receiving the at least one LED bulb, the luminaire having a plurality of sets of optical features, including a first set of optical features and a second set of optical features, the first set of optical features not being identical to the second set of optical features, the first set of optical features being configured for use with the LED bulb emitting a first type light emission, the first type light emission comprising a first combination of a radiation pattern and photometric spectrum, the second set of optical features being configured for use with the LED bulb emitting a second type light emission, the second type light emission comprising a second combination of a radiation pattern and photometric spectrum, wherein the LED bulb does not simultaneously emit the first type light emission and the second type light emission, wherein the first set of optical features modifies the LED bulb's first type light emission to cause the luminaire to output a third type light emission, and wherein the second set of optical features modifies the LED bulb's second type light emission to cause the luminaire to output a fourth type light emission, and wherein the first type light emission and the second type light emission have peak emissions in different directions.

2. The device of claim 1 wherein the at least one LED bulb comprises a first LED bulb emitting the first type light emission and a second LED bulb emitting the second type light emission.

3. The device of claim 1, wherein the first type light emission comprises a first light emission pattern and a first photometric spectrum, and wherein the second type light emission comprises a second light emission pattern different from the first light emission pattern or comprises a second photometric spectrum different from the first photometric spectrum.

4. The device of claim 1, wherein the first set of optical features includes at least one of first reflectors, first refractors, first diffusers, first windows, and first filters that act on the first type of light emission in a particular way to produce the third type light emission, and wherein the second set of optical features includes at least one of second reflectors, second refractors, second diffusers, second windows, and second filters that act on the second type of light emission in a particular way to produce the fourth type light emission.

5. The device of claim 1, wherein the luminaire is used within an automotive application.

6. The device of claim 1, wherein the socket is replaceable so as to be at least one of a first socket or a second socket, and wherein the socket includes a keying mechanism that restricts its use for only the LED bulb emitting the first type light emission.

7. The device of claim 1, wherein the at least one LED bulb comprises an LED bulb electrically controllable to output either the first type light emission or the second type light emission so as to cause the luminaire to output either the third type light emission or the fourth type light emission.

8. The device of claim 1, wherein the at least one LED bulb comprises a first LED bulb that outputs the first type light emission.

9. The device of claim 8, wherein the at least one LED bulb comprises a second LED bulb, wherein the second LED bulb emits the second type light emission.

10. The device of claim 1, wherein the LED bulb comprises a molded plastic cover over a thermally conductive substrate that contains LED dies and optical lenses.

11. The device of claim 1, wherein the bulb contains a plurality of LED dies, where energization of different ones of the dies determines whether the LED bulb emits the first type light emission or the second type light emission.

12. A method of using a light emitting device comprising:

providing a luminaire having a socket receiving a LED bulb containing at least one light emitting diode (LED) die, the luminaire having a plurality of sets of optical features, including a first set of optical features and a second set of optical features, the first set of optical features not being identical to the second set of optical features, the first set of optical features being configured for use with the bulb emitting a first type light emission, the second set of optical features being configured for use with the bulb emitting a second type light emission;

wherein the LED bulb does not simultaneously emit the first type light emission and the second type light emission, wherein the first set of optical features modifies the LED bulb's first type light emission to cause the luminaire to output a third type light emission, wherein the second set of optical features modifies the LED bulb's second type light emission to cause the luminaire to output a fourth type light emission; and selecting either the LED bulb emitting the first type light emission or the LED bulb emitting the second type light emission to cause the luminaire to either output the third type light emission or the fourth type light emission, wherein the first type light emission and the second type light emission have peak emissions in different directions.

13. The method of claim 12, wherein the step of selecting comprises installing a first LED bulb into the socket or a different second LED bulb into the socket.

14. The method of claim 12, wherein the step of selecting comprises energizing particular LED dies in the LED bulb to cause the LED bulb to either emit the first type emission or the second type emission.

15. The method of claim 12, wherein the first type light emission comprises a first combination of a radiation pattern and photometric spectrum, and wherein the second type light emission comprises a second combination of a radiation pattern and photometric spectrum.

* * * * *